US005598829A

United States Patent [19]

Bednar

[11] Patent Number: 5,598,829

[45] Date of Patent: Feb. 4, 1997

[54] CROSSBOW DRY FIRE PREVENTION DEVICE

[75] Inventor: William J. Bednar, Akron, Ohio

[73] Assignee: Hunter's Manufacturing Company, Suffield, Ohio

[21] Appl. No.: 479,728

[22] Filed: Jun. 7, 1995

[51] Int. Cl.[6] ..... F41A 17/00; F41B 5/00

[52] U.S. Cl. ..... 124/25; 124/40; 124/35.2

[58] Field of Search ..... 124/25, 40, 25.6, 124/35.2, 35.1, 31, 80, 86

[56] References Cited

U.S. PATENT DOCUMENTS

| | | | |
|---|---|---|---|
| 4,030,473 | 6/1977 | Puryear | 124/25 X |
| 4,192,281 | 3/1980 | King | 124/25 |
| 4,479,480 | 10/1984 | Holt | 124/35.1 |
| 4,693,228 | 9/1987 | Simonds et al. | 124/40 X |
| 4,716,880 | 1/1988 | Adkins | 124/25 |
| 4,721,092 | 1/1988 | Waiser | 124/40 |
| 4,877,008 | 10/1989 | Troubridge | 124/25 |
| 5,085,200 | 2/1992 | Horton-Corcoran et al. | 124/25 |
| 5,215,069 | 6/1993 | Liu | 124/35.1 X |

*Primary Examiner*—Randolph A. Reese

*Assistant Examiner*—Thomas A. Beach

*Attorney, Agent, or Firm*—Oldham & Oldham Co., LPA

[57] ABSTRACT

The invention is directed to a dry-fire prevention device for use with a crossbow. The crossbow includes a trigger mechanism which may have a guide slot into which a bowstring is drawn and retained for firing. A pivotal string catch member is positioned relative to the trigger mechanism to selectively extend into a string catching position which will catch and retain the bowstring should it be released from the trigger mechanism without an arrow in a firing position in the crossbow. The string catch member may include an arrow contacting surface to engage an arrow positioned to be fired from the crossbow, wherein, movement of the arrow to the firing position causes the string catch member to be moved out of the string catching position. This allows selective release of the bowstring from the guide slot and prevents inadvertent release when no arrow is present in the firing position. The string catch member may be manually removed from the guide slot so as not to interfere with the bowstring, allowing a convenient mechanism to uncock the crossbow without firing. In the preferred embodiment, the dry fire prevention device is automatically reset to prevent inadvertent dry firing of the crossbow after manually releasing the bowstring.

16 Claims, 3 Drawing Sheets

10
12
14
16
20
16
20
70
79
80
72
82
50
30
76
78
74
60
44
42
40
46
48
39
38
52
32
36
34

CROSSBOW DRY FIRE PREVENTION DEVICE

BACKGROUND OF THE INVENTION

This invention generally relates to crossbow trigger mechanisms, and more particularly to a dry fire prevention device provided with the trigger mechanism.

Crossbows have been used for many years as a weapon for hunting, fishing, target shooting and the like. Crossbow designs have increased the force with which an arrow is shot, increasing the stiffness of the bow arms or limbs associated with the crossbow. The bowstring of the crossbow is drawn into a trigger mechanism used to selectively hold and release the bowstring for firing. The increased stiffness of the bow limbs requires that significant force be exerted to draw the bowstring into the trigger mechanism, and thereafter an arrow is loaded in the crossbow for firing. Although trigger mechanisms generally include a safety, which can be automatically set upon drawing the bowstring into the trigger mechanism, limited attempts have been made to prevent inadvertent release of the bowstring when the safety device is disengaged. Such inadvertent release of the drawn bowstring may occur when initially drawing the bowstring into the trigger mechanism, with release of the bowstring occurring without having an arrow in the firing position. Alternatively, the crossbow may be cocked for firing, and shot without having an arrow in the firing position. Such inadvertent release is termed "dry firing" of the crossbow, and can potentially cause injury to the user and almost always results in damaging the crossbow. Dry firing of the crossbow will generally cause damage to the bow limbs of the crossbow, rendering it inoperative. It would therefore be desirable to provide a trigger mechanism which would prevent the crossbow from being dry-fired once the bowstring was drawn into and held in the drawn position before an arrow is in place for firing.

The trigger mechanisms generally provided with crossbows include a bowstring latch which holds the bowstring until a trigger is actuated. The location at which the bowstring is held is generally provided in a forward opening bowstring guide slot, into which a portion of an arrow is inserted subsequently for firing.

SUMMARY OF THE INVENTION

Based upon the foregoing, it is an object of the invention to provide a dry fire prevention device associated with the trigger mechanism of the crossbow, which prevents inadvertent release of a drawn bowstring without an arrow in the firing position.

Another object of the invention is to provide a device which allows the user to more easily release a drawn bowstring in a controlled manner if desired.

The invention is in general directed to a dry-fire prevention device for use with a crossbow. The crossbow includes a trigger mechanism which may have a guide slot into which a bowstring is drawn and retained for firing. A pivotal string catch member is positioned relative to the trigger mechanism to selectively extend into a string catching position which will catch and retain the bowstring should it be released from the trigger mechanism without an arrow in a firing position in the crossbow. The string catch member may include an arrow contacting surface to engage an arrow positioned to be fired from the crossbow, wherein, movement of the arrow to the firing position causes the string catch member to be moved out of the string catching position.

The invention in the preferred embodiment comprises a dry-fire prevention device for use with a crossbow, including a crossbow trigger housing having a guide slot into which a bowstring is drawn, and a trigger mechanism having a pivotal string latch to selectively hold the bowstring in the guide slot. A pivotal string catch member is positioned to selectively extend into at least a portion of the guide slot. The string catch member is selectively removed from the guide slot when an arrow positioned to be fired from the crossbow, wherein, movement of the arrow to the firing position causes the string catch member to pivot out of the guide slot. This allows selective release of the bowstring from the guide slot and prevents inadvertent release when no arrow is present in the firing position.

In another aspect of the invention, the string stop member may be manually pivoted or removed from the guide slot so as not to interfere with the bowstring, allowing a convenient mechanism to uncock the crossbow without firing. In the preferred embodiment, the dry fire prevention device is automatically reset to prevent inadvertent dry firing of the crossbow after manually releasing the bowstring.

BRIEF DESCRIPTION OF THE DRAWINGS

The advantages and objects of the invention will be further understood by reference to the following description of preferred embodiments, taken in connection with the accompanying drawings, wherein.

DETAILED DESCRIPTION OF THE INVENTION

Figures 1, 2:
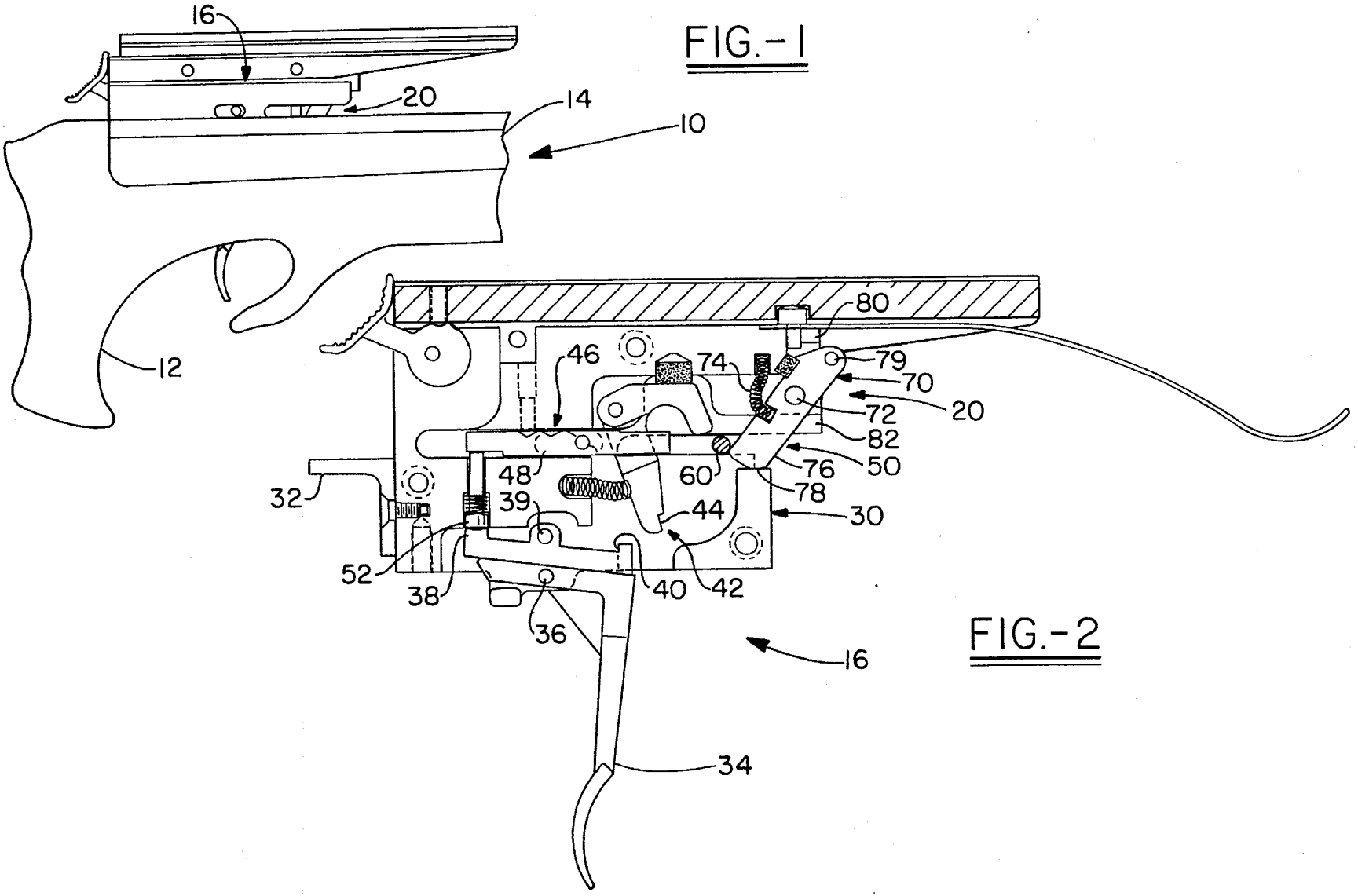
FIG. 1 is a partial side view of a crossbow including a dry fire prevention device in accordance with the invention.
FIG. 2 is a side elevation view of a first embodiment of the invention, shown in association with the trigger mechanism of the crossbow, and with the device actuated to prevent dry firing of the crossbow.

Turning to FIG. 1, a portion of a conventional crossbow 10 is shown, particularly relating to the area of the crossbow including the trigger mechanism used to hold a bowstring for firing. The crossbow 10 includes a stock 12 having front and rear portions held by the user for firing of the crossbow. A barrel 14 provides a top surface on which an arrow is positioned for firing. The trigger mechanism 16 selectively holds a bowstring in a cocked position for firing of the crossbow 10. The dry-fire prevention device 20 of the invention may be used in association with the trigger mechanism 16, or may be formed as a part of the crossbow itself in conjunction with a separate trigger mechanism. A variety of trigger mechanisms are known in the art and may be used in conjunction with the dry fire prevention device 20. The device 20 prevents release of the bowstring from the area at which it is held for firing, unless an arrow is placed in the firing position, to provide the benefits mentioned.

Figure 3:
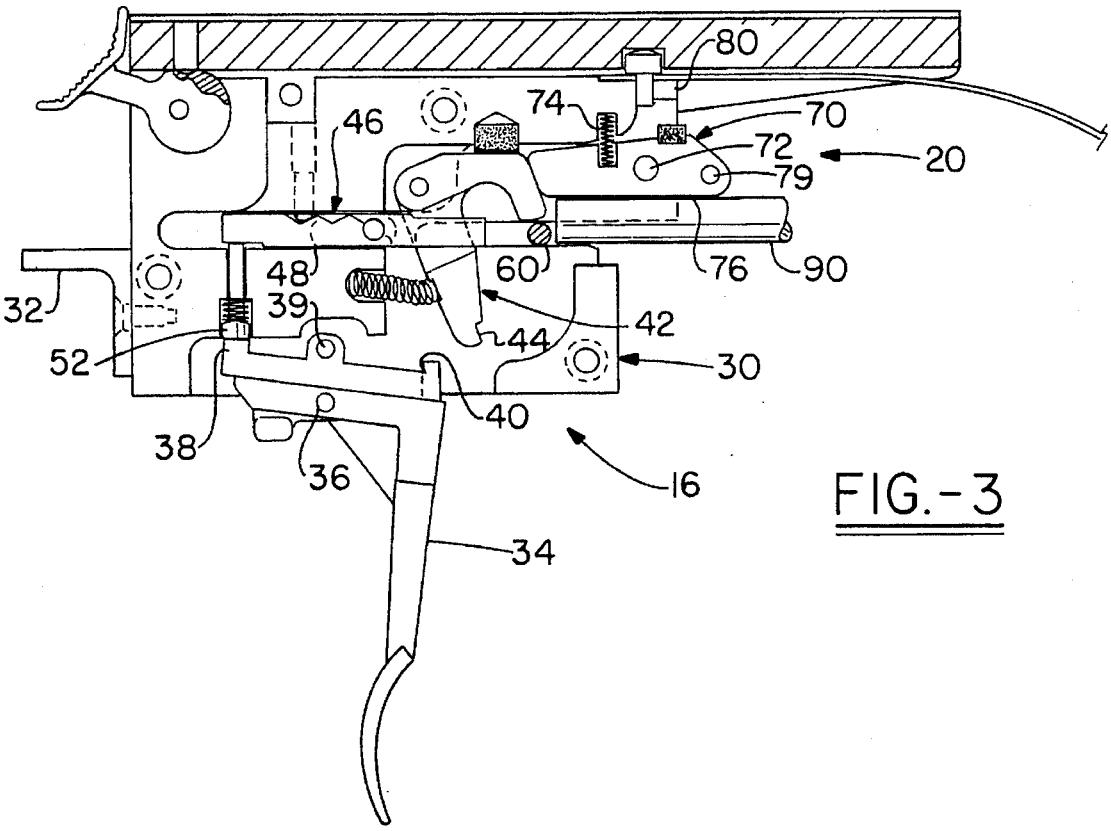
FIG. 3 is a side elevation view of the embodiment as shown in FIG. 2, shown with the crossbow being fired.

In FIGS. 2 and 3, a first embodiment of the invention is shown in more detail, wherein the dry fire prevention device 20 is formed as a part of a trigger mechanism 16. In this embodiment, the trigger mechanism includes a separate housing 30 which is mounted in the crossbow stock shown in FIG. 1. In FIGS. 2 and 3, one-half of the housing 30 has been removed to reveal the trigger components. The housing 30 may hold all of the components of the trigger mechanism to allow it to be completely removed from the stock for adjustment or repair. The housing 30 may be secured within the stock using a tang 32 or another known manner.

Although a particular trigger mechanism 16 is shown, the invention may be used with other trigger mechanisms as desired, and the trigger mechanism may be provided integral to the stock or otherwise to eliminate a separate trigger housing 30. The components of the trigger mechanism 16 in this embodiment include a trigger arm 34, which is pulled rearward by the user for firing of the crossbow. The trigger 34 pivots about pivot point 36, and in turn causes pivoting motion of a rocker latch member 38 mounted in pivot point 39. The rocker latch member 38 includes a first sear surface 40, which cooperates with and engages a sear surface 44 formed as a part of a string release member 42. The trigger 16 may also include a safety mechanism 46, comprising a slide 48, which is movable within housing 30 between safe and firing positions. The slide 48 projects into a forward opening bowstring guide slot 50, into which a bowstring is drawn for cocking of the crossbow. The forward portion of the slide 48 extends through a forked notch formed in the string release latch 42, such that a bowstring drawn into slot 50 will contact the slide 48 to move it rearwardly within housing 30, thereby automatically setting the safety to the safe position to render the trigger mechanism inoperable to fire the crossbow. The safety 46 further includes a trigger stop 52 which is biased against a portion of the rocker latch member 38, such that when slide 48 is moved rearwardly in housing 30, the trigger stop 52 will prevent actuation of the trigger mechanism. Release of the safety 46 may then be performed manually for firing of the crossbow.

In use, the bowstring, indicated at 60, is drawn into the guide slot 50, where it is engaged and held in a drawn position by means of the string release latch 42, which is shown in FIGS. 2 and 3 in the string release position. The string release latch 42 is pivoted to engage sear surface 44 with sear surface 40 of the rocker latch member 38 to retain bowstring 60 within slot 50 as seen in FIG. 3 for subsequent firing of the crossbow. To disengage the bowstring 60 for firing of the crossbow, the trigger 34 is pulled, which in turn pivots the rocker latch member 38 to disengage sear surfaces 40 and 44. This will allow the string release latch 42 to pivot upwardly, providing smooth release of the bowstring from the trigger mechanism 16.

It is desirable to prevent firing of the crossbow without having an arrow loaded in the firing position in association with the trigger housing 16. The dry fire prevention device 20 is designed to prevent release of the bowstring from the area at which it is held for firing, but does not inhibit function of the trigger mechanism 16. As shown in FIG. 2, the dry fire prevention device 20 includes a string catch member 70 which may be mounted in association with the housing 30 of the trigger mechanism 16, or alternatively, could be mounted in association with another portion of the crossbow if desired. In the preferred embodiment, the string catch 70 is positioned to selectively pivot into the region of the guide slot 50 into which the bowstring 60 is drawn, and also providing for positioning of an arrow relative to the string release member 42 so that bowstring 60 will fire an arrow from the crossbow. The string catch 70 is therefore mounted on a pivot point 72, and in the preferred embodiment, the housing 30 will allow pivotal motion of string catch 70 into and out of the guide slot 50. A spring 74 may be used to bias the string catch 70 into a string engaging position relative to the guide slot 50, shown in FIG. 2.

Further shown in FIG. 2, actuation of the trigger 34 will cause pivoting of the string release member 42 to release bowstring 60 from engagement with the trigger mechanism. If an arrow is not positioned in the firing position relative to the trigger housing 30, release of the bowstring could create significant damage to the crossbow itself or potentially be a hazard to the user. The bowstring catch 70 is therefore designed to retain bowstring 60 from fully releasing upon actuation of the trigger mechanism 16 as shown in FIG. 2. In the preferred embodiment, string catch 70 is pivoted into guide slot 50 to catch the bowstring immediately after it is released from the string release latch 42. Alternatively, the catch 70 may be positioned at another point along the path of the bowstring 60 to retain it from fully releasing upon actuation of the trigger for example, the catch 70 may be positioned along the barrel of the crossbow, and may be biased upwardly to engage the bowstring 60 should no arrow be placed along the barrel in the firing position. In this manner, the invention provides a method wherein if the bowstring 60 is inadvertently released from trigger mechanism 16 without an arrow being positioned in the firing position, bowstring 60 will be retained by catch 70 to prevent dry firing of the crossbow. In this embodiment of the invention, the trigger housing 30 has an extended portion 80, which in part forms the guide slot 50 of the trigger mechanism 16. In the preferred embodiment, the guide slot 50 will include a space 82 accommodating an arrow shaft when the arrow is in the firing position as shown in FIG. 3. Alternatively, the crossbow stock may be used to form at least a portion of the guide slot 50 to form a similar configuration for positioning of an arrow. The catch member 70 is designed to pivot into the guide slot 50 in the region in which an arrow is inserted into the guide slot, and includes an arrow contacting surface 76. In FIG. 3, the butt end of an arrow shaft 90 is inserted into guide slot 50, contacting surface 76 of catch member 70 to pivot catch 70 upwardly and out of the guide slot region 50. In this position, catch member 70 will not hinder release of the bowstring 60 to fire the crossbow. Thus, when an arrow shaft 90 is inserted into the firing position, as shown in FIG. 3, actuation of the trigger mechanism 16 will cause firing of the crossbow.

Upon firing of an arrow from the crossbow, the shaft 90 will no longer be in place, and spring 74 will cause catch member 70 to again pivot downwardly into the region of the guide slot 50. The catch member 70 is biased to its position as shown in FIG. 2, and may include a stop surface 78 which engages either a part of the trigger housing 30, or another part of the crossbow such that the stock as an example, to prevent pivotal motion thereof. The catch member 70 is also designed so as not to hinder movement of the bowstring from its cocked position to fire an arrow when properly positioned in the crossbow. In this regard, the stop surface 78 may be configured with a radius on the forward edge, to prevent the bowstring from getting hung up on the catch member 70 when released under proper firing conditions with an arrow inserted in guide slot 50.

Subsequent to proper firing of the crossbow, the string catch member 70 will be positioned as shown in FIG. 2, and thereafter the bowstring may be drawn into the guide slot 50 and held by the trigger mechanism 16 for subsequent firing. Drawing of the bowstring into slot 50 will pivot catch member 70 out of the guide slot 50 for retention by the string release member 42, and thereafter will be biased again to the position as shown in FIG. 2 for preventing dry firing of the crossbow. The device is automatically set in this manner, preventing dry firing of the crossbow without the user having to actuate the device.

In another aspect of the invention, it is sometimes desirable to release a cocked bowstring from its drawn position without actually firing an arrow from the crossbow. When the crossbow is used for hunting or like activities, the crossbow may remained cocked and ready to fire for substantial periods, without an arrow ever being inserted into the crossbow for firing. It may then be desirable to uncock the crossbow for a variety of reasons, presenting a difficult to task to the user. To perform such operation, it has been conventional to simply actuate the trigger mechanism while attempting to hold on to the bowstring so as to release it slowly, thereby preventing the consequences of dry firing. Such a technique is awkward, as the trigger is somewhat displaced from the location of the bowstring. The dry fire prevention device 20 of the invention provides a more convenient method to release a drawn bowstring in a more controlled manner. For this purpose, catch member 70 is provided with a knob 79 designed to extend outwardly from the trigger housing 30 so as to be manipulated by the user. If the user desires to release a drawn bowstring from the trigger mechanism, the trigger mechanism 16 may be actuated, and the bowstring 60 will be retained by the catch member 70 as shown in FIG. 2. Thereafter, the user may pull the bowstring 60 backwards slightly, to a position which will release catch member 70 from its retaining position. Using knob 79, the catch member 70 is manually removed from the region of guide slot 50. Once removed from this region, the user can then slowly release the bowstring 60 in a controlled manner. As the location of the catch member 70 and knob 79 is adjacent the location of the bowstring 60, the user can simply manipulate the catch member 70 subsequent to actuation of the trigger mechanism 16, to release the bowstring 60 in a more controlled manner.

Figure 4:
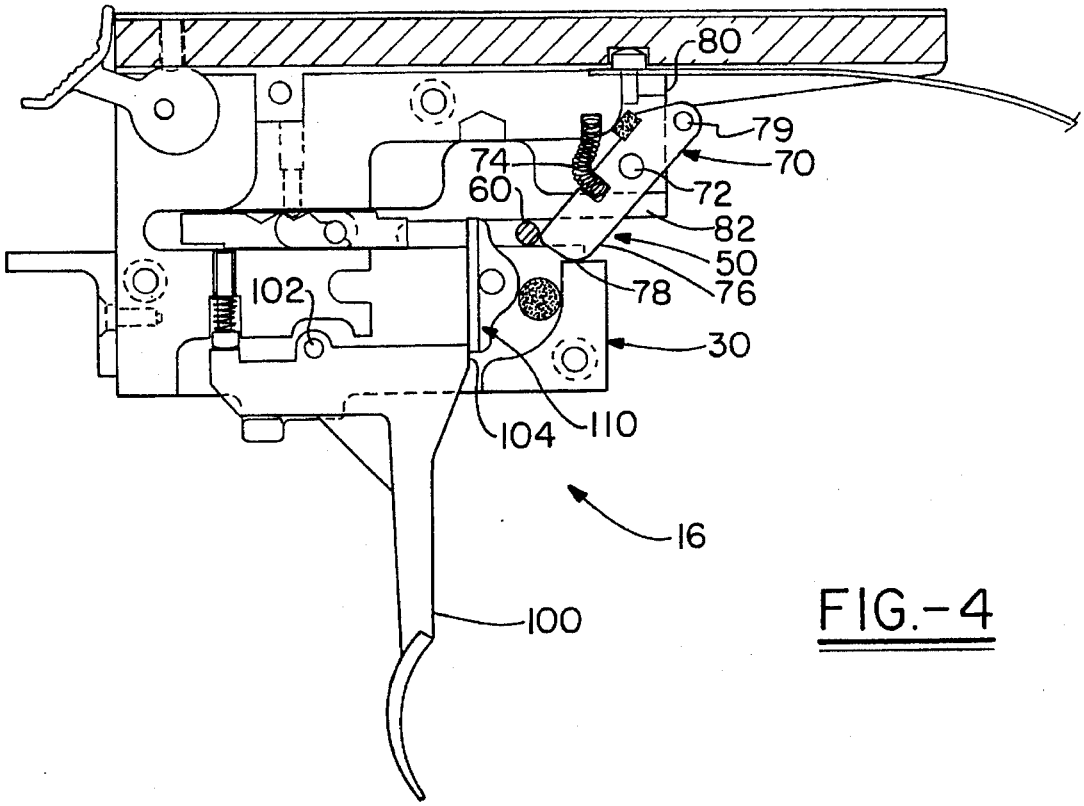
FIG. 4 is a side elevation view of a further embodiment of the invention in association with an alternate trigger mechanism, and showing the device actuated to prevent dry firing of the crossbow.
Figure 5:
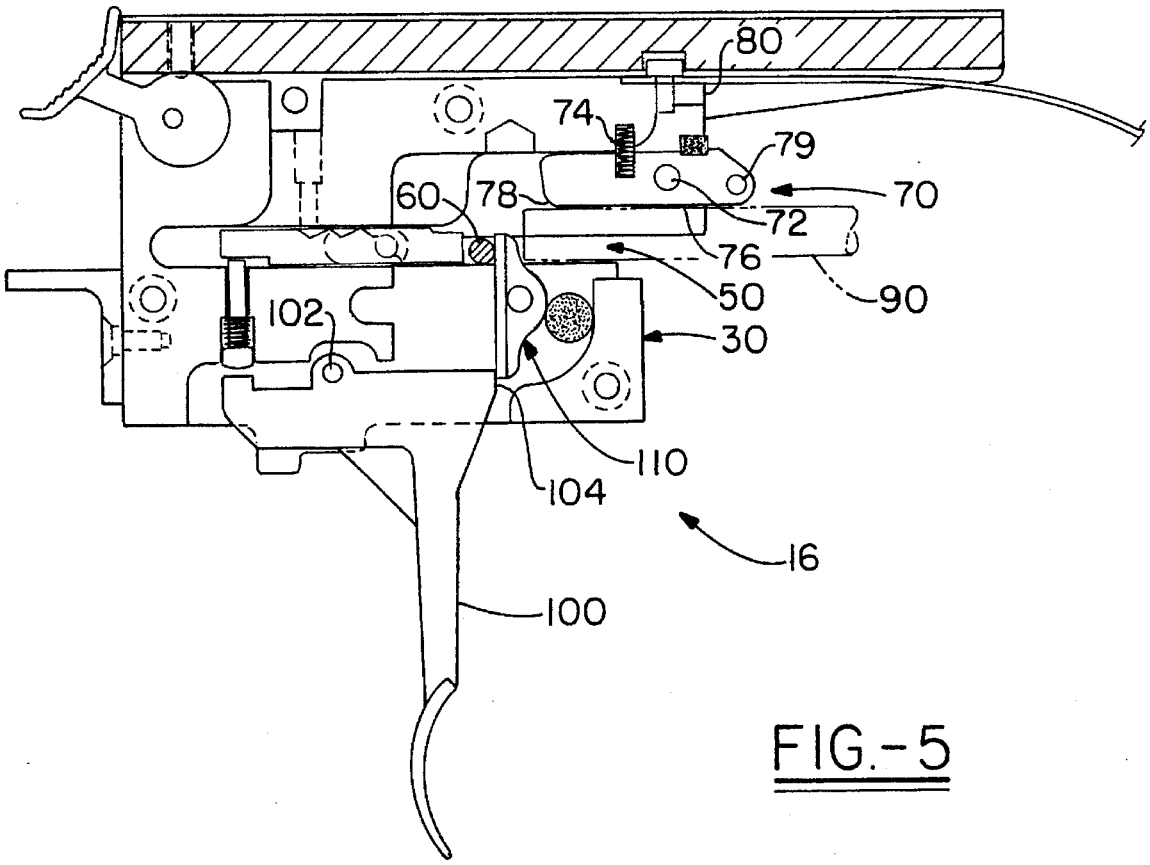
FIG. 5 is a side elevation view of the embodiment of FIG. 4, shown with the crossbow ready to fire.

It should be recognized that the dry fire prevention device of the invention can be used with a variety of trigger mechanisms. In the embodiment of FIGS. 2 and 3, the trigger mechanism 16 was of the up-latch design, wherein string release member 42 pivots upwardly and out of the guide slot 50 to release the bowstring 60. In FIGS. 4 and 5, and alternate trigger mechanism 16 is shown, being of the down-latch design. In this embodiment, the trigger mechanism 16 includes a trigger member 100, which is pivotal about pivot point 102. A forward end 104 provides a stop surface for a pivotal string release latch member 110. The string release member 110 is normally biased to a string engaging position as shown in FIG. 5, wherein a lower portion thereof engages surface 104 to hold bowstring 60 in the guide slot 50 as shown in FIG. 5. Pivotal motion of trigger 100 will release the string release member 110 to allow pivoting thereof downward and out of guide slot 50 for release of the bowstring. The dry fire prevention device 20 of the invention works in a similar manner to that described with reference to FIGS. 2 and 3, to prevent inadvertent release of bowstring 60 without an arrow in the firing position. Other aspects of the trigger mechanism 16 may be similar to those previously described, and again the dry fire prevention device 20 is not to be limited to any particular trigger configuration.

It should also be recognized that the dry fire prevention device 20 of the invention may be formed separately from the trigger mechanism of the crossbow, with it being mounted in an appropriate position relative to the trigger mechanism and/or travel of the bowstring 60 to prevent full release of the bowstring, preferably from the general area at which it is held by the trigger mechanism. Thus, for example, the catch member 70 could be mounted in association with the crossbow stock or another portion thereof, with it being pivotal into the region of a guide slot such as guide slot 50 formed as part of a trigger housing or another guide slot formed in the crossbow to prevent dry firing.

The dry firing device of the invention prevents release of the bowstring without having an arrow in the firing position as desired. Although the invention has been described relative to various preferred embodiments, it is to be understood that various changes or modifications may be made in these embodiments without departing from the scope of the invention disclosed herein, and as set forth in the following claims.

What is claimed is:

1. A dry fire prevention device for use with a crossbow, comprising, a crossbow trigger housing having a bowstring guide slot into which a bowstring is drawn, and including a trigger mechanism having a pivotal string latch to selectively hold said bowstring in said guide slot, and, a pivotal string catch member positioned to selectively extend into at least a portion of said guide slot, wherein said string catch member will retain said bowstring when said string catch member extends into said guide slot, said string catch member having an arrow contacting surface to engage an arrow positioned to be fired from said crossbow, wherein movement of said arrow to the firing position causes said string catch member to pivot out of said guide slot to allow selective release of said bowstring from said guide slot.

2. The dry fire prevention device of claim 1, wherein, said housing has a forward extending portion which forms at least a portion of said guide slot, and said catch member is pivotally mounted on said forward extending portion, such that said catch member extends into a portion of said guide slot forward of said string latch within said guide slot.

3. The dry fire prevention device of claim 1, wherein, said string catch member is pivotally mounted relative to said trigger housing so as to extend into said guide slot.

4. The dry fire prevention device of claim 1, wherein, said catch member is biased into said portion of said guide slot, such that if no arrow is in said firing position, said catch member will extend into said at least portion of said guide slot.

5. The dry fire prevention device of claim 1, wherein, said catch member includes means for manually pivoting said catch member out of said guide slot to allow selective release of said bowstring from said guide slot.

6. A dry fire prevention device as in claim 1, wherein, said string catch member is mounted on a pivot point positioned above said guide slot, and said catch member pivots downwardly into at least a portion of said guide slot, wherein, a lower portion of said catch member provides a stop surface which is engaged with another surface of said crossbow to limit pivotal motion of said catch member in the downward direction.

7. The dry fire prevention device of claim 1, wherein, said string catch member is mounted on a pivot point positioned above said guide slot, and said string catch member pivots downward into at least a portion of said guide slot, wherein, the lower portion of said catch member is provided with a radiused surface.

8. A crossbow having a dry fire prevention device, the crossbow comprising a bowstring, which is selectively held and released by a trigger mechanism, wherein, said bowstring is drawn into a bowstring guide slot for engagement with the trigger mechanism, a pivotal string catch member being positioned to selectively extend into at least a portion of said guide slot to prevent release of said bowstring from said guide slot unless an arrow is positioned in a firing position within said crossbow, wherein, said string catch member will retain said bowstring when said string catch member extends into said guide slot and is engaged by said arrow to be selectively removed from extending into at least a portion of said guide slot, to allow release of said bowstring from said guide slot.

9. The crossbow of claim 8, wherein, said trigger mechanism includes a housing having a forward extending portion which forms at least a portion of said guide slot, and a string latch for selectively retaining said bowstring in said guide slot, wherein said catch member is pivotally mounted on said forward extending portion of said housing, such that said catch member extends into a portion of said guide slot at a position forward of said string latch within said guide slot.

10. The crossbow of claim 8, wherein, said string catch member is pivotally mounted relative to said trigger mechanism so as to extend into said guide slot.

11. The crossbow of claim 8, wherein, said catch member is biased into said portion of said guide slot, such that if no arrow is in said firing position, said catch member will extend into said guide slot.

12. The crossbow of claim 8, wherein, said catch member includes means for manually pivoting said catch member out of said guide slot to allow selective release of said bowstring from said guide slot.

13. A device for preventing inadvertent release of a bowstring of a crossbow without an arrow in place in a firing position within said crossbow, wherein, said bowstring is selectively held and released by means of a trigger mechanism associated with said crossbow, wherein, said device comprises a body member which is positioned to selectively extend into a bowstring catching position when an arrow is not positioned in said firing position, such that said body member will catch and retain a bowstring which is inadvertently released from said trigger mechanism when no arrow is placed in the firing position.

14. The device according to claim 13, wherein, said bowstring is selectively held by said trigger mechanism in a first position and said bowstring catching position is located relative to said first position to catch and retain said bowstring upon release of said bowstring from said first position.

15. The device according to claim 13, wherein, said body member is removed from said bowstring catching position upon placement of an arrow in a firing position relative to said trigger mechanism.

16. A method of preventing the inadvertant release of a bowstring of a crossbow without an arrow in place in a firing position within said crossbow, wherein, said crossbow includes a trigger mechanism and said bowstring is selectively held and released by means of said trigger mechanism, comprising the steps of:

providing a bowstring catch member positioned relative to said trigger mechanism, biasing said catch member into a bowstring catching position relative to said trigger mechanism if an arrow is not placed in a firing position relative to said trigger mechanism, wherein actuation of said trigger mechanism without an arrow placed in said firing position will cause said bowstring to be caught and retained by said catch member.

* * * * *